US005445385A

United States Patent [19]

Brooks

[11] Patent Number: 5,445,385

[45] Date of Patent: Aug. 29, 1995

[54] GOLF TRAINING DEVICE

[76] Inventor: Gary A. Brooks, P.O. Box 58, Twin Lakes, Wis. 53181

[21] Appl. No.: 239,594

[22] Filed: May 9, 1994

[51] Int. Cl.[6] ..... A63B 69/36

[52] U.S. Cl. ..... 273/189 A

[58] Field of Search ..... 273/189 R, 189 A, 187.2

[56] References Cited

U.S. PATENT DOCUMENTS

| | | | |
|---|---|---|---|
| 2,468,580 | 4/1949 | Weis et al. | 273/189 R |
| 2,943,859 | 7/1960 | Koski et al. | 273/189 A |
| 3,074,723 | 1/1963 | Esty | 273/189 R |
| 3,419,276 | 12/1968 | Poggioli | 273/187.2 |
| 3,419,277 | 12/1968 | Martin | 273/189 R |
| 3,658,345 | 4/1972 | Siggson | 273/189 R |
| 3,877,426 | 4/1975 | Nirschl | 273/189 R X |
| 3,900,199 | 8/1975 | McGonagle | 273/189 A |
| 3,975,015 | 8/1976 | Owens et al. | 273/189 A X |
| 3,990,709 | 11/1976 | DeRogatis | 273/189 R |
| 4,476,857 | 10/1984 | Levine | 273/189 A X |
| 4,504,054 | 3/1985 | Jackson et al. | 273/189 A |
| 4,911,728 | 3/1990 | Rigel | 273/189 A |
| 5,069,457 | 12/1991 | Korzenowski | 273/189 R |
| 5,096,199 | 3/1992 | Wyatt, Jr. et al. | 273/189 R |
| 5,174,575 | 12/1992 | Leith | 237/187.2 |

*Primary Examiner*—George J. Marlo

*Attorney, Agent, or Firm*—Dressler, Goldsmith, Shore & Milnamow, Ltd.

[57] ABSTRACT

A golf training device that minimizes bending of the golfer's leading arm during a golf swing. The device comprises a laminated body that includes an inner cushion layer, and intermediate rigidifying layer and an outer decorative layer. The laminated body has sufficient flexibility to be formed into a cylindrical sleeve in close fitting conformity with the golfer's arm disposed therein. Strap and buckle means are secured to the laminated body on opposite sides of the centerline thereof for removably securing the device in place.

4 Claims, 2 Drawing Sheets

10
12
14
14a
14b
16
18
20
20a
22
24
26
28a
28b
30a
30b
30d
32a
32b
34a
34b
36a
36b
40
4

GOLF TRAINING DEVICE

FIELD OF THE INVENTION

The invention generally relates to an athletic teaching or training device, and more particularly, the invention relates to a training device for teaching a golfer to keep his or her leading arm straight during a golf swing.

BACKGROUND OF THE INVENTION

One of the most common flaws in the swing of a poor or average golfer is the failure to keep his or her leading arm straight during the golf swing. Leading arm, as used herein, refers to the left arm of a right-handed golfer and the right arm of a left-handed golfer. If the elbow of the leading arm is loose and permits the leading arm to bend or flex during the golf swing, the arc traveled by the clubhead is reduced, resulting in a reduction clubhead speed at the point of impact with the ball. By failing to keep the leading arm straight, it is difficult to consistently return the clubhead to a square, level position at impact, which leads to miss-hit balls or errant shots.

Various different types of athletic training devices have been proposed in the past, and are exemplified by U.S. Pat. Nos. 2,468,580; 3,074,723, 3,419,276; 3,419,277; 3,658,345; 3,877,426; 3,900,199; 3,975,015; 3,990,709; 4,476,857, 4,911,728; 4,504,064; 5,069,457; 5,096,199 and 5,174,575. For a variety of different reasons, none of the various devices disclosed in the aforementioned patents have met with commercial success.

SUMMARY OF THE INVENTION

The golf training device in accordance with the present invention is a significant improvement over devices that have been proposed in the past, in that it accomplishes its teaching function with a structure that is easy to put on and remove, and which is convenient to store when not in use. The device is sufficiently stiff in use to accomplish its flexure resistant function, yet it is cushioned to minimize discomfort to the golfer. When not in use, the device is compact for convenient storage.

More specifically, the device includes a generally rectangular laminated body comprised of an inner cushioning layer adapted to be disposed adjacent to the golfer's arm, an intermediate rigidifying or stiffening layer, and an outer decorative layer. They layers are generally coextensive, and may be held in face-to-face juxtaposition with one another by sewing, adhesive bonding, sonic welding, and the like. A decorative trim member is stitched, or sewn, around the periphery of the laminated body, and serves to assist in retaining the layers in association with one another.

In a preferred embodiment of the invention, the stiffening layer is a thin, flexible plastic sheet that permits the initially flat body to be rolled, or formed into a hollow, generally cylindrical configuration. When placed in this configuration at the elbow joint of the leading arm of a golfer, the body exhibits sufficient resistance to bending so that the golfer's arm will remain straight throughout the golf stroke. The device includes adjustable attachment means for retaining the body in the hollow, generically cylindrical configuration.

In the most preferred embodiment of the device the body is dimensioned such that it has a width dimension larger than the largest circumferential dimension of the golfer's arm. As a result, when the securement means are adjusted and engaged, opposite end portions of the body overlap one another to provide a reinforced spine to increase the device's resistance to bending. If applied correctly, the region of overlap is at the inside of the golfer's leading arm, i.e., adjacent to the golfer's body and facing the golfer's other arm.

One of the important aspects of the present invention is to provide a "quick-connect/quick-disconnect" securement system, so that the device can be quickly and easily applied, and removed, and adjusted as applied to insure that the device fits sufficiently tightly around the golfer's leading arm. To this end, in a most preferred embodiment, the device includes generally identical first and second attachment means each spaced generally equally from the centerline of the body, so that in use, each attachment means is spaced substantially the same distance from the point axis of the elbow of the golfer's leading arm. In this way a force applied to the device at its approximate mid-portion during a golf swing by the golfer's elbow, is resisted generally equally by the attachment means as a result of their being spaced generally equally form the centerline of the body.

The attachment means of the present invention is preferably universally adjustable, and includes first and second generically identical strap means spaced equally on opposite side of the centerline of the body of the device. In this way, equal bending resistant forces can be applied to the device on opposite sides of the elbow joint at distances spaced generally equally therefrom. Each attachment means includes a relatively short flexible first strap having a buckle at the end thereof in general alignment with one side edge of the body, and a relatively long flexible second strap secured at its inner end portion to the mid-section of the body. Each second strap is free of the body (except at its inner end), with its outer end extending a substantial distance beyond a second edge of the body.

The device is applied by forming the body into a cylindrical configuration, with the strap edge of the body overlapping the buckle edge thereof. The free ends of the straps are then inserted into their respective buckles and tightened to reduce the diameter of the body and to bring the device into close fitting conformity with the golfer's leading arm. The device may be removed by simply loosening the straps, expanding the diameter of the body and slipping the device off of the golfer's arm.

DETAILED DESCRIPTION OF THE PREFERRED EMBODIMENT

Figure 2:
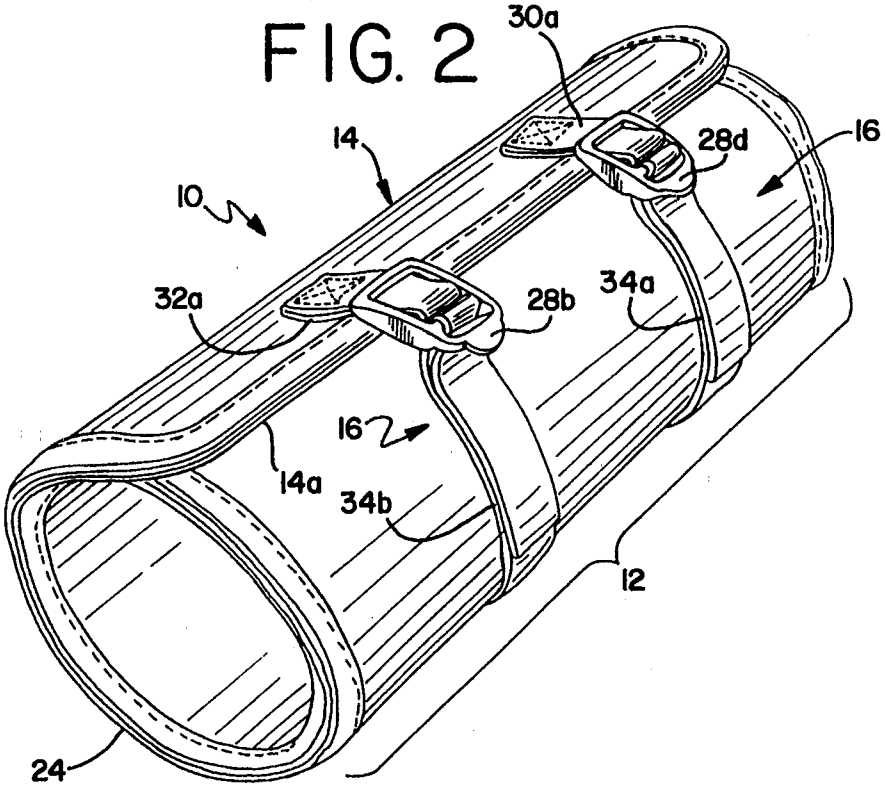
FIG. 2 is an enlarged perspective view of the device in its in-use configuration.

While this invention is susceptible of embodiment in many different forms, there is shown in the drawings and will herein be described in detail a preferred embodiment of the invention, with the understanding that the present disclosure is to be considered as an exemplification of the principles of the invention and is not intended to limit the invention to the embodiment illustrated.

Figure 1:
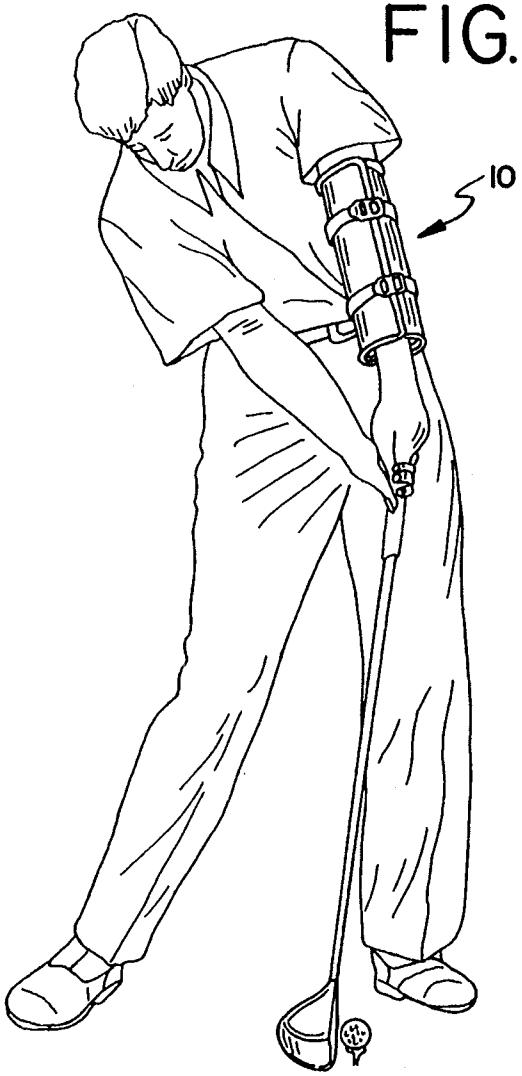
FIG. 1 is a perspective view of a golfer with the device of the present invention in place on the golfer's leading arm.

Referring now to FIG. 1, a right-handed male golfer is shown with the device 10 of the present invention in place on his left arm. Device 10, while originally flat as shown in FIG. 4, is rolled and formed into a generally hollow cylindrical configuration in-use, as is evident from FIGS. 1 and 2. As is also evident from FIGS. 1 and 2, device 10 has an in-use length dimension 12 which enables the device to extend a substantial distance above and below the golfer's elbow joint, thereby effectively mobilizing the elbow joint and preventing the arm from bending during a practice stroke. In this way, device 10 teaches the golfer to keep the leading arm straight at address, during the back-swing, during the down-swing, at impact, and during the follow-through.

Device 10 consists of a generally rectangular body 14, adapted to be positioned in close fitting conformity with the golfer's leading arm, and attachment means 16 for retaining the body 14 in that position.

As can be best seen in FIG. 4, body 14 is a laminated structure consisting of an inner outer layer 18 adapted to be positioned adjacent to the golfer's arm, an intermediate layer 20 coextensive in external dimension with layer 18, and an outer layer 22 coextensive in external dimension with layers 18 and 20 and adapted to face outwardly when the device is in place on a user's arm.

Inner layer 18 is a cushioning layer for minimizing discomfort to the golfer when the body is tightened into close fitting conformity with the golfer's arm. While various different materials are contemplated for layer 18, closed cell rubber foam of 0.125" thickness is presently preferred. In addition to its cushioning effect, layer 18 also functions to assist in retaining device 10 in place during use by preventing it from slipping on the golfer's arm.

Intermediate layer 20 is a stiffening or rigidifying layer, that serves to retain body 14 in its cylindrical configuration when attachment means 16 are tightened. While the material of layer 20 is not critical, layer 20 must possess sufficient inherent structural rigidity that when formed into its cylindrical configuration, it will resist buckling, or bending, as the golfer's elbow would tend to flex or bend during a golf swing. A polypropylene sheet 0.040 in. thick has been found suitable for purposes of the present invention.

Outer layer 22 is primarily a decorative layer, and an oxford Lycra nylon fabric has been found suitable for purposes of the present invention. The present invention contemplates that layer 22 could be completely eliminated, in which case the outer surface 20*a* of intermediate layer 20 could be treated so as to have the desired decorative appearance.

A trim piece 24 is folded into a U-shaped configuration and is secured around the peripheral edges of layers 18, 20 and 22. Trim piece 24 is preferably a fabric that is secured in place by sewing or stitching, as shown at 26. The stitches 26 preferably extend through layers 18, 20 and 22 to assist in retaining them in face-to-face juxtaposition with one another.

The means 16 for attaching the device 10 to the golfer's arm includes a pair of buckles 28*a* and 28*b* attached to respective short, flexible strap members 30*a* and 30*b*. The strap members 30*a* and 30*b* have a length dimension which positions buckles 28*a* and 28*b* immediately adjacent to one lateral side edge margin 14*a* of body 14. The innermost ends of strap members 30*a* and 30*b* are stitched, or sewn, to body 14 as shown at 32*a* and 32*b*. Preferably, stitches 32*a* and 32*b* extend through layers 18, 20 and 22 to assist in retaining the layers in face-to-face juxtaposition with one another.

Attachment means 16 further includes flexible strap members 34*a* and 34*b* extending outwardly from side marginal edge 14*b* of body 14. The innermost ends of strap members 34*a* and 34*b* are stitched, or sewn, to body 14, as shown at 36*a* and 36*b*. Preferable stitches 36*a* and 36*b* extend through layers 18, 20 and 22 to assist in retaining the layers 18, 20 and 22 in face-to-face juxtaposed relationship with one another. Strap members 34*a* and 36*b* are unattached to body 14, except as shown at 36*a* and 34*b*.

Figures 3, 4:
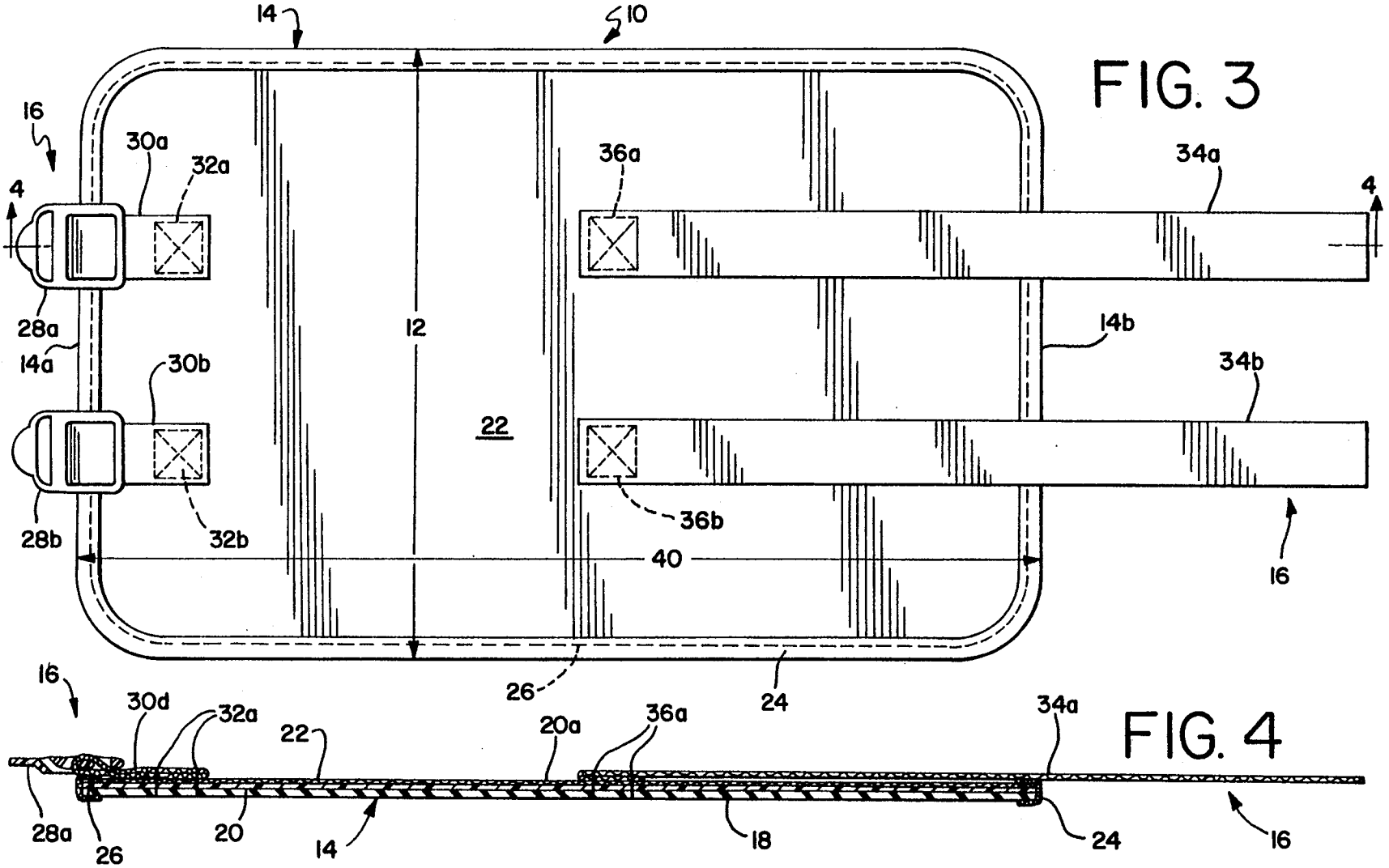
FIG. 3 is a plan view of the device laid out flat.
FIG. 4 is a cross-sectional view taken generally along line 4—4 of FIG. 3.

Thus, when it is desired to use device 10, the free ends of strap members 34*a* and 34*b* are inserted into buckles 28*a* and 28*b* and the device is formed into a cylindrical configuration, as shown in FIGS. 1 and 2, with edge 14*a* overlapping edge 14*b*. Strap members 34*a* and 34*b* are tightened until the inner layer 18 of the device 10 is positioned in close fitting conformity with the golfer's leading arm. Hook and loop fastening means (such as VELCRO) may be substituted for buckles 28*a* and 28*b*, if desired.

The width dimension 40 of the body 14 is selected so as to completely encircle the golfer's arm, and provide an overlap, as shown in FIGS. 1 and 2. The overlapped region provides a rigidifying spine for increased resistance to bending. In an adult size device, i.e., for individuals 5'6" in height or taller, it is contemplated that dimensions 12 and 14 will be about 13" and 16" respectively; whereas in a junior size device, it is contemplated that dimensions 12 and 14 will be about 9" and 14", respectively.

Straps 34*a* and 34*b* are spaced equally from the centerline of the body, so that substantially equal bending resistant forces are exerted, when the device is properly applied with the elbow joint disposed at the centerline of the body.

While layers 18, 20 and 22 may be held in laminated relationship by sewing or stitching alone (as at 26, 30*a*, 30*b*, 36*a* and 36*b*) it is contemplated that other lamination means, in combination with stitching, or as an alternative thereto (such as sonic welding, adhesive bonding, etc.) are also within the purview of the present invention.

From the foregoing, it will be observed that numerous modifications and corrections can be effected without departing from the true spirit and scope of the novel concept of the present invention. It will be understood that no limitation with respect to the specific embodiments illustrated herein is intended or should be inferred. The disclosure is intended to cover, by the appended claims, all such modifications as fall within the scope of the claims.

What is claimed is:

1. A golf training device comprising: a generally rectangular laminated body, said body having a length dimension so as to define a generally rectilinear upper portion adapted to be disposed above a user's elbow and a generally rectilinear lower portion generally coplanar with said upper portion and adapted to be disposed below the user's elbow, said body having a width dimension sufficient to enable the body to completely encircle the user's arm and said body being generally uniformly flexible so as to permit said body to be formed into a contractable tubular sleeve without pronounced hinge points and adapted to fit over the user's arm with opposite side margins of said body in overlapped relationship relative to one another; first and second strap means on the outer surface of said body and associated and generally parallel with the upper and lower portions of said body, respectively, for constricting the diameter of said tubular sleeve to dispose and maintain the interior thereof in close fitting conformity with the golfers arm disposed therein, said first and second strap means being independently adjustable whereby said upper and lower portions of said body can be constricted differing amounts to accommodate arm portions of varying and different dimensions; and said laminated body including an inner cushion layer adapted to be disposed adjacent to the user's arm and a rigidifying layer for maintaining said body in the form of said tubular sleeve to minimize bending of the user's elbow during a golf stroke, said layers being generally coextensive with said body and extending from one side margin of said body to the other and from said upper body portion to said lower body portion.

2. A golf training device as set forth in claim 1 wherein said strap means are secured to said body by attachment means secured to each layer of said laminated body.

3. A golf training device as set forth in claim 1 wherein the upper and lower portions of said body are of equal size and disposed symmetrically about the centerline of said body.

4. A golf training device as set forth in claim 3 wherein the strap means associated with the upper and lower positions of said body comprise first and second oppositely extending strap members positioned equally from and parallel with the centerline of said body, the inner ends of said strap members being secured to said body by attachment means, and at least said first strap members being free of attachment to said body outwardly from the inner ends thereof.

* * * * *